US005673624A

United States Patent [19]

Grundke

[11] Patent Number: 5,673,624

[45] Date of Patent: Oct. 7, 1997

[54] DEVICE FOR FASTENING AND TENSIONING PACKINGS ON A CYLINDER OF A SHEET-FED ROTARY PRINTING MACHINE

[75] Inventor: Edgar Grundke, Ditzingen, Germany

[73] Assignee: Heidelberger Druckmaschinen Aktiengesellschaft, Heidelberg, Germany

[21] Appl. No.: 622,440

[22] Filed: Mar. 25, 1996

[30] Foreign Application Priority Data

Mar. 23, 1995 [DE] Germany ..... 195 10 648.2

[51] Int. Cl.[6] ..... B41F 1/28

[52] U.S. Cl. ..... 101/415.1

[58] Field of Search ..... 101/415.1

[56] References Cited

U.S. PATENT DOCUMENTS

| | | | |
|---|---|---|---|
| 247,140 | 9/1881 | Wilhelm | 101/415.1 |
| 967,079 | 8/1910 | Stipe | 101/415.1 |
| 1,686,065 | 10/1928 | Blaine | 101/415.1 |
| 2,619,904 | 12/1952 | Mosegaard | 101/415.1 |
| 3,119,331 | 1/1964 | Koch et al. | 101/415.1 |
| 3,608,487 | 9/1971 | Luehrs | 101/415.1 |
| 4,367,679 | 1/1983 | Ishii et al. | 101/410 |
| 4,890,555 | 1/1990 | Bryer et al. | 101/415.1 |

FOREIGN PATENT DOCUMENTS

| | | |
|---|---|---|
| 0072797 | 5/1970 | Germany . |
| 3100114 | 11/1981 | Germany . |
| 4011303 | 10/1991 | Germany . |
| 4034494 | 3/1992 | Germany . |
| 1320118 | 6/1973 | United Kingdom . |
| 1574185 | 9/1980 | United Kingdom . |
| 2242649 | 10/1991 | United Kingdom . |

*Primary Examiner*—Edgar S. Burr
*Assistant Examiner*—Amanda B. Sandusky
*Attorney, Agent, or Firm*—Nils H. Ljungman and Associates

[57] ABSTRACT

A device for fastening and tensioning packings on a cylinder of a sheet-fed rotary printing machine, comprising a groove formed in the cylinder body and extending in axial direction, clamping elements being provided in said groove for clamping the end of the packing and being actuated by a shaft, thus ensuring that the end of the packing is reliably gripped and tensioned, without particular holding means being assigned to the end of the packing.

10 Claims, 3 Drawing Sheets

DEVICE FOR FASTENING AND TENSIONING PACKINGS ON A CYLINDER OF A SHEET-FED ROTARY PRINTING MACHINE

BACKGROUND OF THE INVENTION

1. Field of the Invention

The present invention generally relates to a device for fastening and tensioning packings on a cylinder of a sheet-fed rotary printing machine, such a cylinder comprising a groove formed in the cylinder body and extending in an axial direction, wherein clamping elements actuated by a shaft, for clamping the end of the packing, are disposed in the groove.

2. Background Information

German Patent No. 40 34 494 C1 discloses a device such as that described above, in which different clamping elements act on one side of the packing in order to fasten and tension the packing. Due to this unilateral effect of the clamping elements, the tensile force to be applied onto a respective end of the packing is limited.

OBJECT OF THE INVENTION

Proceeding from this known realization, it is an object of the present invention to provide a device ensuring a reliable gripping and tensioning of a respective end of a packing, without the need for particular holding means to be assigned to that end of the packing.

SUMMARY OF THE INVENTION

According to the present invention, this object is achieved, in accordance with at least one preferred embodiment, in that a clamping element having clamping surfaces is provided on a tensioning rail, wherein the clamping surfaces narrow outwards. Disposed between the clamping surfaces are clamping jaws, between which a respective end of the packing is inserted. The tensioning rail is mounted on the shaft, with the shaft being supported on holding fingers that penetrate the tensioning rail in the vicinity of recesses formed in the clamping element and that are fastened to the cylinder body. The shaft features control surfaces for actuating the tensioning rail and the clamping jaws, and, via compression springs, the tensioning rail is supported on the cylinder body.

The solution described immediately above makes it possible to "tong" the end of the packing and to pull it inside the cylinder body by turning the shaft. By virtue of the control surfaces provided on the shaft, the tensioning rail may be moved into a receiving position, a clamping position (in which the end of the packing is clamped), and a tensioning position (in which the packing is tensioned). Since only the shaft has to be turned, it is possible for the machine operator to change packings in a very short time and to ensure that the new packing is reliably tensioned. The "tonging" of the end of the packing by means of clamping jaws ensures that the packing is reliably held, that the end of the packing is prevented from sliding out from between the clamping jaws during machine operation.

An advantageous embodiment of the invention is characterized in that there are, disposed below the clamping jaws, thrust members which are supported on separate control surfaces provided on the shaft and which, via a leaf-spring, move the clamping jaws (that tension the end of the packing) outwardly. The thrust members cause the clamping jaws to be closed before a tensile force is applied onto the end of the packing. The leaf spring ensures that the thrust members are tensioned uniformly so that no tolerances will result in any negative effects on the tensioning of the packing.

An advantageous embodiment for tensioning the packing is characterized in that the shaft is rotated from a position in which the shaft abuts (with its inclined control surface) against the holding fingers into a position in which the outer cylindrical surface of the shaft abuts against the holding fingers so that the tensioning rail, with the clamping jaws, is moved inside the cylinder body. As a result of the great holding force exerted by the clamping jaws, the mounted end of the packing is reliably tensioned so that all functions are carried out upon the shaft performing a simple rotary motion.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

A specimen embodiment of the invention is schematically illustrated in the drawings.

DESCRIPTION OF THE PREFERRED EMBODIMENT

Figure 1:
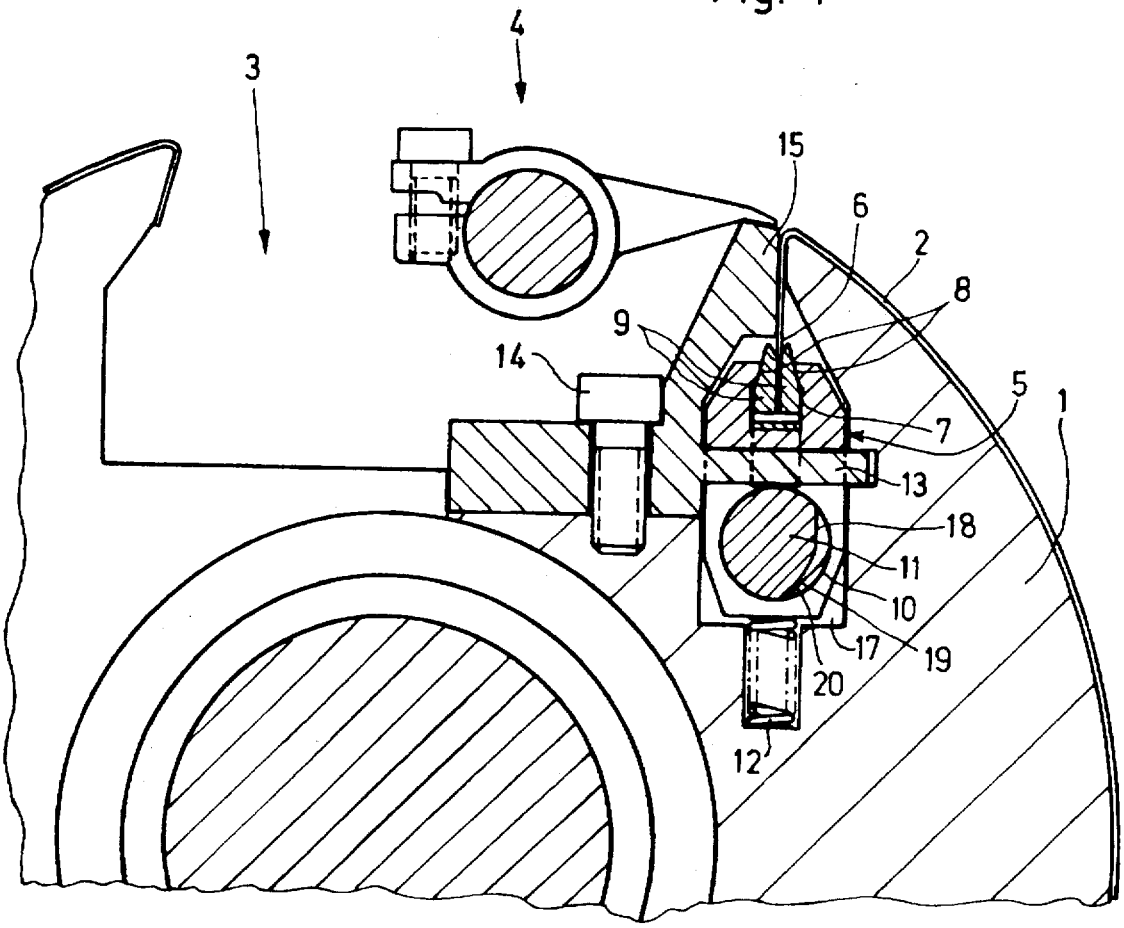
FIG. 1 is a cross-sectional detail view of a cylinder comprising a tensioning device.

With reference to the drawings, packings 2, possibly required for print-related reasons, are mounted and tensioned on the outer cylindrical surface of cylinder 1. The cylinder 1 preferably features a groove 3 extending in the axial direction. Groove 3 preferably accommodates the tensioning arrangement for tensioning the packings and, if necessary, also accommodates gripper devices 4 for conveying the printed sheets. A clamping element 7, for fastening and tensioning the end 6 of the packing 2, and featuring two clamping surfaces 8 which narrow outwardly i.e. towards the outer cylindrical surface), is provided on a tensioning rail 5. Two clamping jaws 9 are disposed between the clamping surfaces 8. The outer surfaces of the clamping jaws 9 correspond to the clamping surfaces 8.

According to the embodiment shown in FIG. 1, the clamping jaws 9 may be displaced within the clamping element 7 in a horizontal direction, thus producing a gap between the clamping jaws 9, into which the end 6 of the packing 2 may be inserted. The tensioning rail 5 features a longitudinal bore 10, by means of which bore 10 the tensioning rail 5 is mounted on a shaft 11. Over the length of the tensioning rail 5, several compression springs 12 are provided, pressing the tensioning rail 5, together with the shaft 11, upwardly such that the shaft 11 abuts against holding fingers 13. Via screws 14, the holding fingers 13 are fastened to the bottom of the groove 3. As shown in FIG. 1, it is also conceivable to provide the holding fingers 13 with a gripper-pad rail 15 extending over the length of the cylinder 1. The holding fingers 13 penetrate the tensioning rail 5 in the vicinity of recesses 16 (see FIG. 5) in order that the tensioning rail 5 may execute a perpendicular motion. For the purpose of executing a perpendicular motion, the tensioning rail 5 is displaceably mounted, on both sides thereof, in a channel 17.

FIG. 1 shows the packing 2 in a tensioned position, with the shaft 11 being rotated clockwise until it abuts, with its outer cylindrical surface, against the holding fingers 13. In this position, the tensioning rail 5 is moved, against the force of compression springs 12, as far inward as possible into the interior of the cylinder. By rotating the shaft 11 anticlockwise, a first control surface 18 abuts against the holding fingers 13 so that the compression springs 12 push the tensioning rail 5 upwards. A second control surface 19 does not change this position of the tensioning rail 5; however, it corresponds to a third control surface 20. The function of the control surfaces 18, 19, 20 is illustrated in FIGS. 2, 3 and 4.

Figure 2:
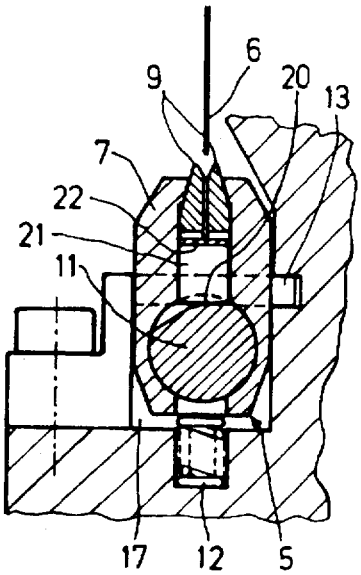
FIG. 2 is a cross-sectional view of the tensioning device in a "receiving" position.

FIG. 2 shows the thrust members 21 supported on control surfaces 20 of shaft 11. In this specimen embodiment, the shaft 11 abuts with its control surfaces 19 against the holding fingers 13 so that the tensioning rail 5 is in its upper position. The clamping jaws 9, too, have been pushed back into the clamping element 7 so that the end 6 of the packing 2 may be easily inserted between the clamping jaws 9. In this case, a leaf spring 22 is provided between the lower end of the clamping jaw 9 and the thrust member 21.

Figure 3:
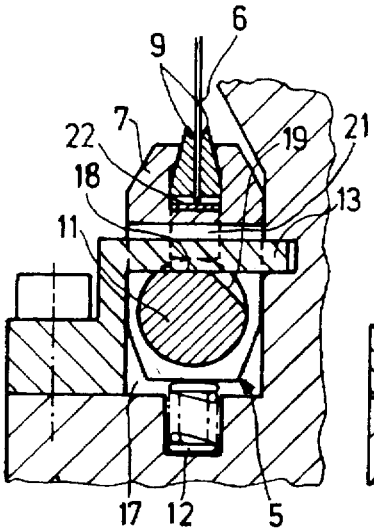
FIG. 3 is a cross-sectional view of the tensioning device in a "clamping" position.

FIG. 3 shows the shaft 11 in a rotated position in which the control surface 18 abuts against the holding fingers 13. In this position, the thrust member 21 has been lifted to such a level that it rests on the outer cylindrical surface of the shaft 11 and has pushed, via the leaf spring 22, the clamping jaws 9 outwardly to such a degree that the end 6 of the packing 2 has been firmly mounted and tensioned.

Figure 4:
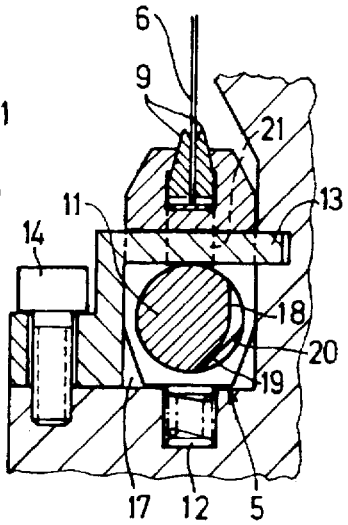
FIG. 4 is a cross-sectional view of tensioning device in a "tensioning" position.

FIG. 4 shows a position in which the shaft 11 has been rotated clockwise somewhat further so that its outer cylindrical surface abuts against the holding fingers 13. As a result, the tensioning rail 5 has been pushed inwardly into the interior of the cylinder to such a degree that the packing 2 has been firmly tensioned on the outer cylindrical surface of cylinder 1.

Figure 5:
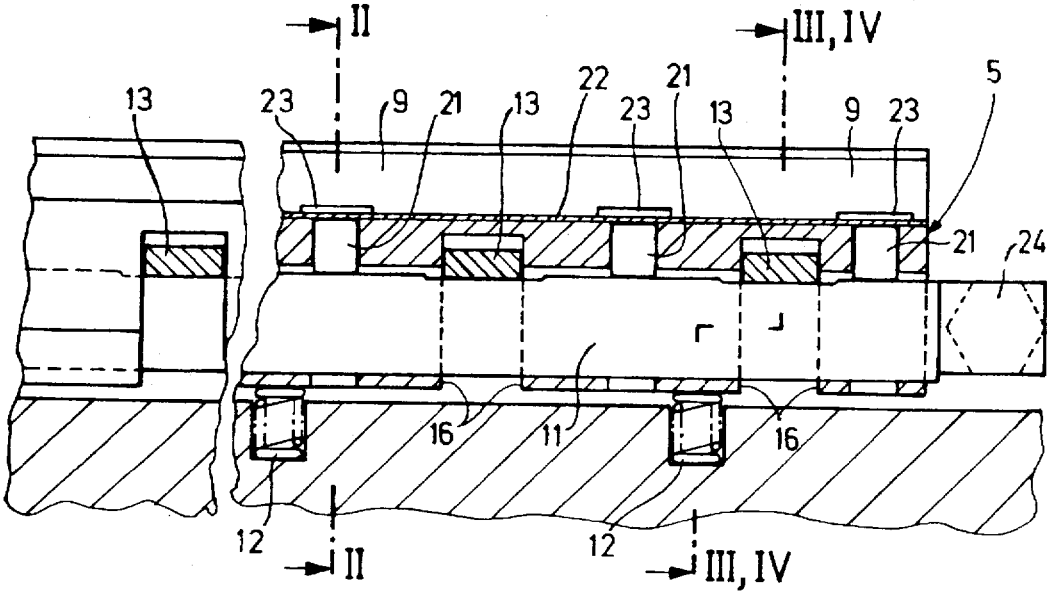
FIG. 5 is a longitudinal sectional detail view of the device.

FIG. 5 shows the clamping jaws 9 and the thrust members 21 provided below, and supported on, shaft 11. In the region of the thrust members 21, behind the leaf springs 22, recesses 23 are provided in the clamping jaws 9 in order to compensate for the tolerances existing with respect to the end of the packing or the clamping jaw 9, so that, if necessary, the leaf spring 22 may be bent more or less when supporting the clamping jaws 9. As a result, assentially all inaccuracies may be compensated for. In order to rotate the shaft 11 in the longitudinal bore 10 of the tensioning rail 5, a hexagon piece 24 may be provided on the end of the tensioning rail 5, wherein the hexagon piece would enable the machine operator to effect, by means of a wrench, a rotation into a respective position.

The "tonging" action afforded in accordance with at least one preferred embodiment of the present invention will be appreciated from the disclosure herein. Particularly, it will appreciated, that, in accordance with at least one preferred embodiment of the present invention, the clamping jaws 9 serve to grasp a packing end from two sides in the manner of conventional tongs and facilitate this end of the packing being pulled into the body of the cylinder. It is believed, in accordance with at least one preferred embodiment of the present invention, that such "tonging" results in a secure and reliable holding of the packing end in question and that the likelihood of any slippage of the packing end, with respect to the grasp of the clamping jaws 9, is substantially minimized.

It will be appreciated that, in accordance with at least one preferred embodiment of the present invention, the mere rotation of shaft 11 can result in three separate and distinct actions of the tensioning apparatus according to the present invention. It will further be appreciated that these three separate and distinct actions, effected by mere rotation of shaft 11, are afforded by various manners of relative displacement between separate and independently displaceable components.

Thus, it will be appreciated that, in a first "receiving" position of the tensioning apparatus, thrust members 21 lie against control surface 20 and clamping jaws 9 are spread apart somewhat slightly in order to be able to accommodate the end 6 of packing 2. Since, in accordance with at least one preferred embodiment of the present invention, the degree of separation between clamping jaws 9 can be dictated by the relative vertical position (i.e. in a vertical direction with respect to FIGS. 2, 3, and 4) of clamping jaws 9 with respect to clamping element 7, it will be appreciated that, in FIG. 2, the clamping jaws 9 are at such a vertical position with respect to clamping element 7 that they are sufficiently separated from one another to be able to accommodate the end 6 of packing element 2.

In a "clamping" position of the tensioning apparatus as shown in FIG. 3, the shaft 11 will preferably have been turned clockwise and the orientation or "lay" of the outer cylindrical surface of the shaft 11, upon which thrust members 21 now rest, will preferably be such so as to have the effect of pushing clamping jaws 9 further upwardly (with respect to FIG. 3) with respect to clamping element 7. In this manner, although clamping element 7 might not displace in a vertical direction with respect to FIG. 3, the clamping jaws 9 will converge towards each other in a horizontal direction with respect to FIG. 3, with the result that the end 6 of packing 2 can be sufficiently and tightly clamped.

Finally, with respect to the "tensioning" position shown in FIG. 4, it will be appreciated that even further clockwise rotation of shaft 11 can result in the ensemble of clamping member 7 and clamping jaws 9 being simultaneously displaced inwardly into the cylinder, i.e. in a downward vertical direction with respect to FIG. 4. In this instance, thrust members 21 will preferably be resting on the outer cylindrical surface of shaft 11.

It will be understood, then, that in accordance with at least one preferred embodiment of the present invention, control surfaces 18, 19, and 20 may preferably be oriented and configured in such a manner with respect to the outer cylindrical surface of shaft 11 that the behavior described heretofore, i.e. the transition of the tensioning apparatus from a "receiving" position to a "clamping" position to a "tensioning" position, will be most efficiently facilitated. Thus, it is to be understood that the drawings provide but one example of an arrangement of components that may be utilized within the scope of the present invention in order to effect the desired behavior, and that other arrangements are conceivable within the scope of the present invention.

The terms "packing" and "packing cylinder" should be sufficiently well-known to those of ordinary skill in the art so as not to warrant any further substantive description thereof herein. However, several U.S. patents, listed at the close of the instant specification, provide examples of "packing" and "packing cylinders" that have components, or at least embodied concepts, that can be utilized within the scope of the present invention.

Further, it is conceivable, in embodiments of the present invention, for a "packing cylinder" to correspond to a blanket cylinder of any offset rotary printing press, and for the "packing" itself to correspond to a component formed from rubber, such as a rubber blanket, in the context of an offset rotary printing press.

Figure 6:
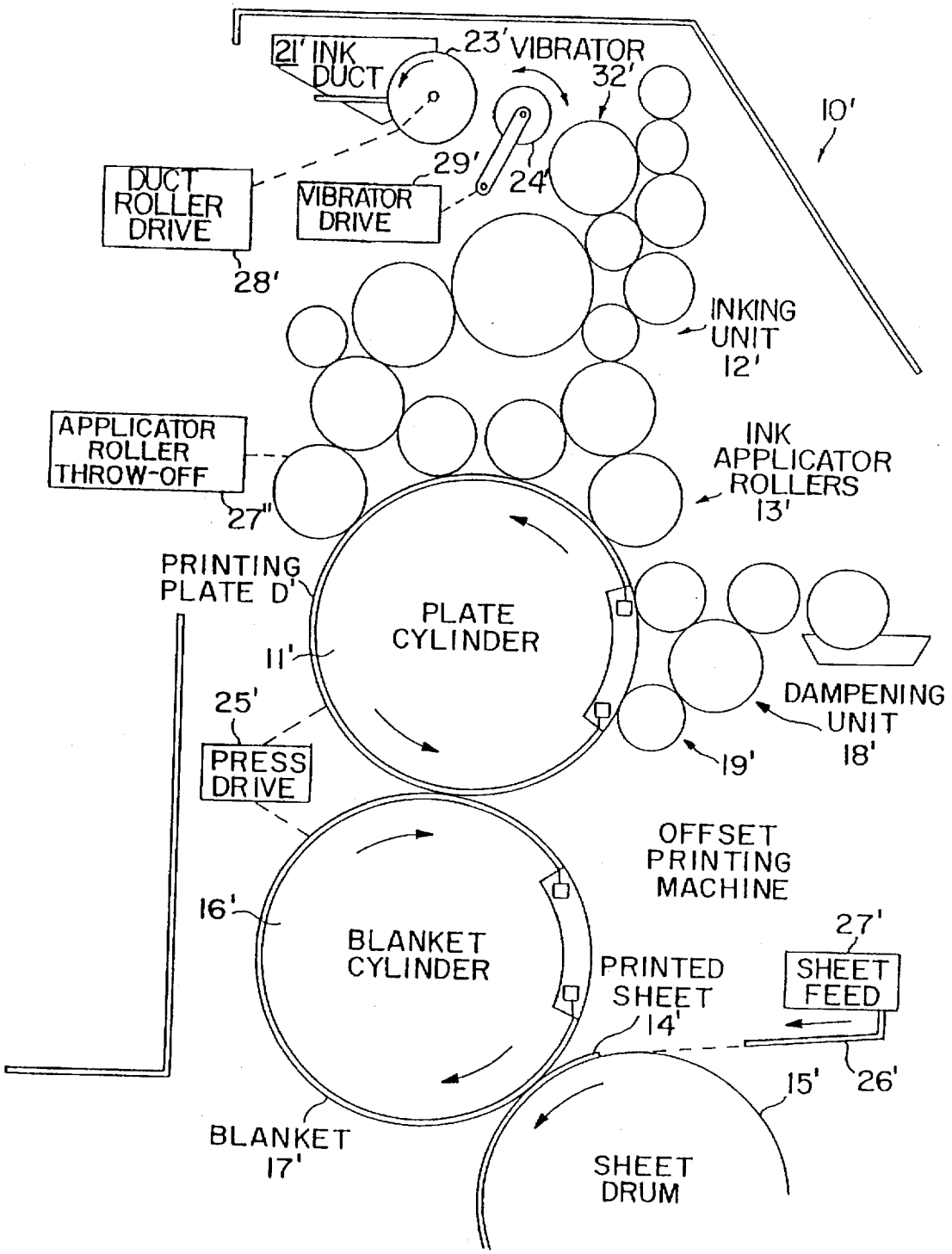
FIG. 6 is a schematic elevational view of a printing unit of an offset rotary printing press.

FIG. 6 illustrates a rotary print stand 10' of a rotary printing press which can employ a packing cylinder according to the present invention. Rotary print stand 10' generally includes: a plate cylinder 11' for having mounted thereon a printing plate D'; an inking unit 12' which includes ink applicator rollers 13' for applying ink to the printing plate an ink profile; a dampening (or wetting) unit 18' having dampening applicator rollers 19' for transferring a dampening agent to the printing plate, a blanket cylinder 16' carrying a rubber blanket 17' for receiving an ink impression from the printing plate D', and a sheet drum 15' for carrying a printed sheet 14' onto which the ink impression carried by blanket 17' is transferred. A duct roller 23' is typically mounted adjacent to ink duct 21'. Typically, ink is transferred from duct roller 23' to inking unit 12' by means of a vibrator roller 24' which oscillates to successively pick up ink from duct roller 23' and deposit the same on a roller 32' of inking unit 12'. Typically, the printing stand 10' will also include auxiliary mechanisms such as, for example, a duct roller drive 28', a vibrator roller drive 29', an applicator roller throw-off 27" for lifting the ink applicator rollers 13+ off of the printing plate D', a press drive 25' and a sheet feed 27' for supplying the sheets to be printed 26' to sheet drum 15'.

One feature of the invention resides broadly in the device for fastening and tensioning packings on a cylinder of a sheet-fed rotary printing machine, comprising a groove formed in the cylinder body and extending in axial direction, clamping elements for clamping a respective end of a packing being provided in said groove and being actuated by a shaft, characterized in that a clamping element 7 having clamping surfaces 8 is provided on a tensioning rail 5, said clamping surfaces narrowing outwards, that clamping jaws 9 are provided between said clamping surfaces 8, a respective packing end 6 being insertable between said clamping jaws 9, that said tensioning rail 5 is mounted on a shaft 11, with said shaft 11 being supported on holding fingers 13 penetrating said tensioning rail 5 in the area of recesses 16 formed in said tensioning rail 5 and being fastened to a cylinder body 1, that said shaft 11 features control surfaces 18, 19 20 for actuating said tensioning rail 5 and said clamping jaw 9, and that, via compression springs 12, said tensioning 5 is supported on said cylinder body 1.

Another feature of the invention resides broadly in the device characterized in that below the clamping jaws 9 are provided thrust members 21 which are supported on separate control surfaces 20 of the shaft 11 and, via a leaf spring 22, move said clamping jaws 9 outwards in order to tension the end 6 of packing 2.

Yet another feature of the invention resides broadly in the device characterized in that in order to tension the packing 2 the shaft 11 is rotated such that it is rotated from a position in which said shaft 11 abuts with an inclined control surface 18 against the holding fingers 13 into a position in which the outer cylindrical surface of said shaft 11 abuts against said holding fingers 13 so that the tensioning rail 5 is moved together with the clamping jaws 9 inwards into the cylinder body 1.

Examples of printing presses, and components therefor, which may be utilized in accordance with the embodiments of the present invention, may be found in the following U.S. Pat. Nos.: No. 5,170,706, which issued to Rodi et al. on Dec. 15, 1992; No. 5,081,926, which issued to Rodi on Jan. 21, 1992; and No. 5,010,820, which issued to Löffler on Apr. 30, 1991.

Examples of various components associated with packing cylinders, packing arrangements and arrangements for grasping packings, which may be utilized in accordance with the embodiments of the present invention, may be found in the following U.S. Pat. Nos.: No. 4,367,679, which issued to Ishii et al. on Jan. 11, 1983; No. 5,415,097, which issued to Junghans on May 16, 1995; No. 5,102,744, which issued to Wirz et al. on Apr. 7, 1992; and No. 4,687,698, which issued to Weil et al. on Aug. 18, 1987.

Examples of general gripping arrangements and blanket arrangements, having components that may be utilized in accordance with the embodiments of the present invention, may be found in the following U.S. Pat. Nos.: No. 5,473,983, which issued to Maul on Dec. 12, 1995; No. 5,272,978, which issued to Wehle et al. on Dec. 28, 1993; and No. 5,076,165, which issued to Pollich on Dec. 31, 1991.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 195 10 648.2, filed on Mar. 23, 1995, having inventor Edgar Grundke, and DE-OS 195 10 648.2 and DE-PS 195 10 648.2, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Device for fastening and tensioning packings on a cylinder, with an axially extending groove disposed therein, of a sheet-fed rotary printing machine comprising:

a shaft;

clamping elements for clamping a respective end of a packing;

said clamping elements for being disposed in a groove of a cylinder;

said clamping elements being disposed to be actuated by said shaft;

said clamping elements comprising:

clamping surfaces;

said clamping surfaces narrowing outwards;

clamping jaws; and said clamping jaws being disposed between said clamping surfaces;

a tensioning rail;

said tensioning rail comprising recesses;

said tensioning rail being mounted on said shaft;

said clamping element being disposed on said tensioning rail;

said shaft comprising control surfaces for actuating said tensioning rail and said clamping jaws;

holding fingers;

said holding fingers extending through said tensioning rail and supporting said shaft in the area of said recesses of said tensioning rail;

compression springs; and said compression springs supporting said tensioning rail on a cylinder.

2. The device according to claim 1, further comprising:

thrust members; and said thrust members are disposed adjacent to said clamping jaws.

3. The device according to claim 2, wherein:

said control surfaces of said shaft comprise a first control surface; and said thrust members are supported on said first control surface of said shaft.

4. The device according to claim 3, further comprising a leaf spring for tensioning an end of a packing.

5. The device according to claim 4, wherein said thrust members and said leaf spring are disposed to actuate said clamping jaws to grasp an end of a packing.

6. The device according to claim 5, wherein:

said control surfaces of said shaft comprise an outer cylindrical surface and a second control surface; and said shaft is rotatable around an axis from a first position in which said second control surface of said shaft make contact with said holding fingers into a second position in which said outer cylindrical surface of said shaft makes contact with said holding fingers to tension a packing.

7. The device according to claim 6 wherein said tensioning rail and said clamping jaws are disposed to move towards the center of a cylinder to tension a packing.

8. The device according to claim 1, wherein:

said control surfaces of said shaft comprise an outer cylindrical surface and a first control surface; and said shaft is rotatable around an axis from a first position in which said first control surface of said shaft makes contact with said holding fingers into a second position in which the outer cylindrical surface of said shaft make contact with said holding fingers to tension a tension a packing.

9. The device according to claim 8 wherein said tensioning rail and said clamping jaws are disposed to move towards the center of a cylinder to tension a packing.

10. Device for fastening and tensioning packings on a cylinder of a sheet-fed rotary printing machine comprising:

a groove formed in the cylinder and extending in an axial direction;

a shaft;

means for clamping a respective end of a packing provided in said groove and actuated by said shaft;

said clamping means comprising:

a clamping element having clamping surfaces narrowing outwards;

clamping jaws provided between said clamping surfaces;

a tensioning rail containing recesses, said tensioning rail being mounted on said shaft and supporting said clamping element;

said shaft containing control surfaces for actuating said tensioning rail and said clamping jaws, said shaft supporting said tensioning rail;

holding fingers, said holding fingers penetrating said tensioning rail and supporting said shaft in the area of said recesses of said tensioning rail; and compression springs, said compression springs supporting said tensioning rail on said cylinder.

* * * * *

UNITED STATES PATENT AND TRADEMARK OFFICE

CERTIFICATE OF CORRECTION

PATENT NO. : 5,673,624

DATED : October 7, 1997

INVENTOR(S) : Edgar GRUNDKE

It is certified that error appears in the above-identified patent and that said Letters Patent is hereby corrected as shown below:

In column 3, line 61, after 'result,', delete "assentially" and insert --essentially--.

In column 5, line 39, after 'rollers', delete "13+" and insert --13'--.

Signed and Sealed this

Seventh Day of April, 1998

Bruce Lehman

*Attest:*

BRUCE LEHMAN

*Attesting Officer*

*Commissioner of Patents and Trademarks*